US009962952B2

(12) United States Patent
Stangler et al.

(10) Patent No.: US 9,962,952 B2
(45) Date of Patent: May 8, 2018

(54) SENSOR FOR IDENTIFYING REGISTRATION MARKS ON A RIBBON

(71) Applicant: Assa Abloy AB, Stockholm (SE)

(72) Inventors: Jeffrey Lee Stangler, Eden Prairie, MN (US); Tanya Jegeris Snyder, Edina, MN (US); James Andrew Rieck, Brooklyn Park, MN (US); Andrew William Slotto, New Hope, MN (US)

(73) Assignee: Assa Abloy AB, Stockholm (SE)

( * ) Notice: Subject to any disclaimer, the term of this patent is extended or adjusted under 35 U.S.C. 154(b) by 3 days.

(21) Appl. No.: 15/277,378

(22) Filed: Sep. 27, 2016

(65) Prior Publication Data

US 2017/0087870 A1 Mar. 30, 2017

(30) Foreign Application Priority Data

Sep. 28, 2015 (CH) ..... 1400/15

(51) Int. Cl.
*B41J 2/325* (2006.01)
*B41J 35/36* (2006.01)
*B41J 17/36* (2006.01)

(52) U.S. Cl.
CPC ..... *B41J 2/325* (2013.01); *B41J 17/36* (2013.01); *B41J 35/36* (2013.01)

(58) Field of Classification Search
CPC ..... B41J 2/325; B41J 35/36; B41J 17/36
See application file for complete search history.

(56) References Cited

U.S. PATENT DOCUMENTS 4,910,533 A * 3/1990 Sasaki ..... B41J 35/18 347/178
5,068,528 A * 11/1991 Miller ..... G01D 5/34 250/226

(Continued)

FOREIGN PATENT DOCUMENTS

CN 103625122 3/2014
EP 1717053 A1 11/2006

(Continued)

OTHER PUBLICATIONS

Search Report from Switzerland Patent Application No. CH01400/15 dated Jan. 26, 2016.

(Continued)

*Primary Examiner* — Julian Huffman
*Assistant Examiner* — Michael Konczal
(74) *Attorney, Agent, or Firm* — Brian D. Kaul; Westman, Champlin & Koehler, P.A.

(57) ABSTRACT

In a method of detecting a location of a print section of a transfer ribbon, the transfer ribbon is fed in a feed direction relative to a print section sensor. The print section sensor includes a reflective sensor and a transmissive sensor. The reflective sensor is positioned upstream of the transmissive sensor relative to the feed direction. A registration mark on the transfer ribbon, which indicates the location of the print section on the transfer ribbon, is detected using the reflective sensor. The registration mark is detected using the transmissive sensor. The location of the print section is determined based on the detection of the registration mark using the transmissive sensor.

16 Claims, 6 Drawing Sheets

(56) References Cited

U.S. PATENT DOCUMENTS

| | | | | |
|---|---|---|---|---|
| 5,381,167 | A * | 1/1995 | Fujii | G03G 15/0152 347/116 |
| 5,992,973 | A * | 11/1999 | Wen | B41J 11/0065 347/19 |
| 6,428,222 | B1 | 8/2002 | Dunham | |
| 6,655,287 | B2 * | 12/2003 | Jojima | B41J 2/325 101/485 |
| 6,962,451 | B2 * | 11/2005 | Narita | B41J 17/32 347/178 |
| 7,277,109 | B2 | 10/2007 | Ueda | |
| 8,436,734 | B2 * | 5/2013 | Kato | B41J 11/46 340/572.1 |
| 2005/0063756 | A1 | 3/2005 | Countryman et al. | |
| 2005/0079298 | A1 * | 4/2005 | Keeton | B41J 35/36 428/32.6 |
| 2016/0185126 | A1 * | 6/2016 | McNestry | B41J 35/36 347/213 |

FOREIGN PATENT DOCUMENTS

| | | | |
|---|---|---|---|
| GB | 2224975 | | 5/1990 |
| JP | 2000033781 | A | 2/2000 |
| JP | 2000071548 | | 3/2000 |
| WO | 0137208 | A2 | 5/2001 |
| WO | 2013025746 | A1 | 2/2013 |

OTHER PUBLICATIONS

Extended European Search Report for corresponding EP Application No. 16190308.3, dated Apr. 24, 2017.

* cited by examiner

SENSOR FOR IDENTIFYING REGISTRATION MARKS ON A RIBBON

CROSS-REFERENCE TO RELATED APPLICATION

The present application is based on and claims the benefit of Swiss application Serial No. 01400/15, filed Sep. 28, 2015, the content of which is hereby incorporated by reference in its entirety.

FIELD

Embodiments of the present invention relate to a sensor for identifying marks on a printer ribbon, such as a transfer ribbon, to align the printer ribbon to a processing device, such as a print head or a transfer device, for example. The sensor combines a reflective sensor and a transmissive sensor to provide reliable and accurate registration mark identification and location detection. Additional embodiments relate to methods of detecting registration marks on a printer ribbon using the sensor and, more specifically, to methods of detecting a location of print sections of a transfer ribbon and aligning the print sections to one or more processing devices using the sensor.

BACKGROUND

Credentials include identification cards, driver's licenses, passports, and other documents. Such credentials are formed from credential or card substrates including paper substrates, plastic substrates, cards, and other materials. Such credentials generally include printed information, such as a photo, account numbers, identification numbers, and other personal information. Credentials can also include data that is encoded in a smartcard chip, a magnetic stripe, or a barcode, for example.

Credential production devices include processing devices that process credential substrates by performing at least one processing step in forming a final credential product. Such processes generally include a printing process, a laminating or transfer process, a data reading process, a data writing process, and/or other process used to form the desired credential.

In a printing process, a printing device is used to print an image either directly to the substrate (i.e., direct printing process) or to a print intermediate, from which the image is transferred to the substrate (i.e., reverse-image transfer printing process). Typical printing devices include a thermal print head, which prints an image by heating and transferring dye from a print ribbon, and an ink jet print head.

In a transfer or laminating process, an overlaminate material is transferred to a surface of the card substrate using a transfer device, such as a heated laminating or transfer roller. The overlaminate material may be in the form of a patch laminate or a thin film laminate. The overlaminate material is typically one of two types: a patch laminate, or a fracturable laminate or transfer layer often referred to as a "thin film laminate." The patch laminate is generally a pre-cut polyester film that has been coated with a thermal adhesive on one side. The transfer roller is used to heat the patch to activate the adhesive, and press the adhesive-coated side of the patch to a surface of a substrate to bond the patch to the surface.

Thin film laminates or transfer layers are fracturable laminates that are generally formed of a continuous resinous material that have been coated onto a carrier layer or backing to form a transfer ribbon. The side of the resin material that is not attached to the continuous carrier layer is generally coated with a thermal adhesive which is used to create a bond between the resin and a surface of a substrate. The transfer roller is used to heat the transfer layer to activate the adhesive and press the adhesive-coated side of the transfer layer against the surface of the substrate to bond the material to the surface. The carrier layer or backing is removed to complete the lamination or transfer process.

The transfer layer or patch laminate may also be in the form of a print intermediate, on which an image may be printed in the reverse-image printing process mentioned above. In the reverse-image printing process, the print head is registered (i.e., aligned) with a print section of the transfer ribbon, and a printing process is performed to print an image on the print section using the print head. Next, the imaged print section is registered with the transfer device and a substrate. The transfer device is then used to perform the transfer or laminating operation described above to bond the imaged print section of the transfer layer or patch laminate to the surface of the card substrate.

Registration of the print sections to the print head, transfer device and substrates, typically involves detecting registration marks on the transfer ribbon that identify the locations of the print sections using an optical sensor. A controller of the credential production device controls the feeding of the transfer ribbon relative to the print head and/or transfer device based on the detection of the registration marks.

Misalignment between the print head and the print section, or between the imaged print section and the transfer device, can result in a defective credential product. Accordingly, it is critical that the registration marks are accurately detected to allow for precise registration of the print sections to the print head during print operations, and to allow for precise registrations of the imaged print sections to the transfer device and substrates during the transfer process. Unfortunately, conventional optical sensors are susceptible to misidentifying non-registration marks, such as portions of an image printed to the transfer ribbon using the print head, as registration marks.

SUMMARY

Some embodiments of the invention are directed to a method of detecting a location of a print section of a transfer ribbon. In some embodiments, the transfer ribbon includes a plurality of registration marks, each of which corresponds to one of a plurality of print sections. Additional embodiments are directed to a print section sensor that is configured for use in carrying out the method. Still further embodiments of the invention are directed to a credential production device that includes the print section sensor and is configured to perform the method.

In some embodiments of the method, the transfer ribbon is fed in a feed direction relative to a print section sensor. In some embodiments, the print section sensor comprises a reflective sensor and a transmissive sensor. In some embodiments, the reflective sensor is positioned upstream of the transmissive sensor relative to the feed direction. Also in the method, a registration mark on the transfer ribbon is detected using the reflective sensor. The registration mark is detected using the transmissive sensor. The location of the print section is determined based on the detection of the registration mark using the transmissive sensor. In some embodiments, an output signal from the reflective sensor is analyzed by a controller to determine whether the detected mark is an actual or real registration mark, and an output signal from the transmissive sensor is used by the controller to determine the location of the registration mark, from which the location of the associated print section is determined.

In some embodiments of the method, the print section of the transfer ribbon is aligned to a print head based on the detection of the location of the print section. An image is printed to the detected print section using the print head.

In some embodiments of the method, the print section of the transfer ribbon is aligned to a transfer device based on the detection of the location of the print section. In some embodiments, the detected print section is transferred to a surface of a substrate using the transfer device.

In some embodiments of the method, the print section sensor comprises a housing. In some embodiments, the reflective sensor comprises a first emitter and a first receiver that are supported by the housing on a first side of the transfer ribbon. In some embodiments, the transmissive sensor comprises a second emitter and a second receiver that are supported by the housing on opposing sides of the transfer ribbon.

In some embodiments, the registration mark is detected using the reflective sensor by emitting first electromagnetic energy from the first emitter, and detecting a magnitude of the first electromagnetic energy reflected from the registration mark using the first receiver. In some embodiments, the determination that the detected registration mark is an actual registration mark comprises comparing the magnitude of the first electromagnetic energy to a first threshold value using the controller.

In some embodiments of the method, the detection of the position of the registration mark using the transmissive sensor comprises emitting second electromagnetic energy from the second emitter, and detecting a magnitude of the second electromagnetic energy transmitted through the transfer ribbon using the second receiver. In some embodiments of the method, the magnitude of the second electromagnetic energy is compared to a second threshold value using the controller.

In some embodiments, the registration mark is located on a first side of a carrier layer of the transfer ribbon, that is generally opposite the print sections.

Some embodiments of the print section sensor include a housing, a reflective sensor, and a transmissive sensor. The housing is configured to be positioned adjacent to a transfer ribbon feed path. The reflective sensor is supported by the housing and is configured to detect registration marks, each of which indicates a location of one of the print sections on the transfer ribbon. The transmissive sensor is supported by the housing and is configured to detect the registration marks. The reflective sensor is located upstream of the transmissive sensor relative to a feed direction of the transfer ribbon.

In some embodiments of the print section sensor, the reflective sensor comprises a first emitter and a first receiver that are supported by the housing on a first side of the transfer ribbon. In some embodiments, the transmissive sensor comprises a second emitter and a second receiver that are supported by the housing on opposing sides of the transfer ribbon.

In some embodiments, the reflective sensor includes a first emitter and a first receiver that are supported by a first section of the housing. In some embodiments, the transmissive sensor includes a second receiver supported by a second section of the housing that is separated from the first section by a gap. In some embodiments, the transmissive sensor includes a second emitter supported by the first section of the housing.

In some embodiments, the housing includes a third section that connects the first section to the second section. In some embodiments, the housing is U-shaped or J-shaped.

In some embodiments of the print section sensor, the first and second sections of the housing extend along a first axis that is transverse to the feed direction. In some embodiments, the third section of the housing extends along a second axis that is perpendicular to the first axis and is transverse to the feed direction.

In some embodiments, the second receiver is displaced from the first emitter and the first receiver along a third axis that is perpendicular to the first and second axes and parallel to the feed direction. In some embodiments, the second emitter is displaced from the first emitter along the first axis toward the second section of the housing. In some embodiments, the gap extends along the second axis between the first and second sections of the housing.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
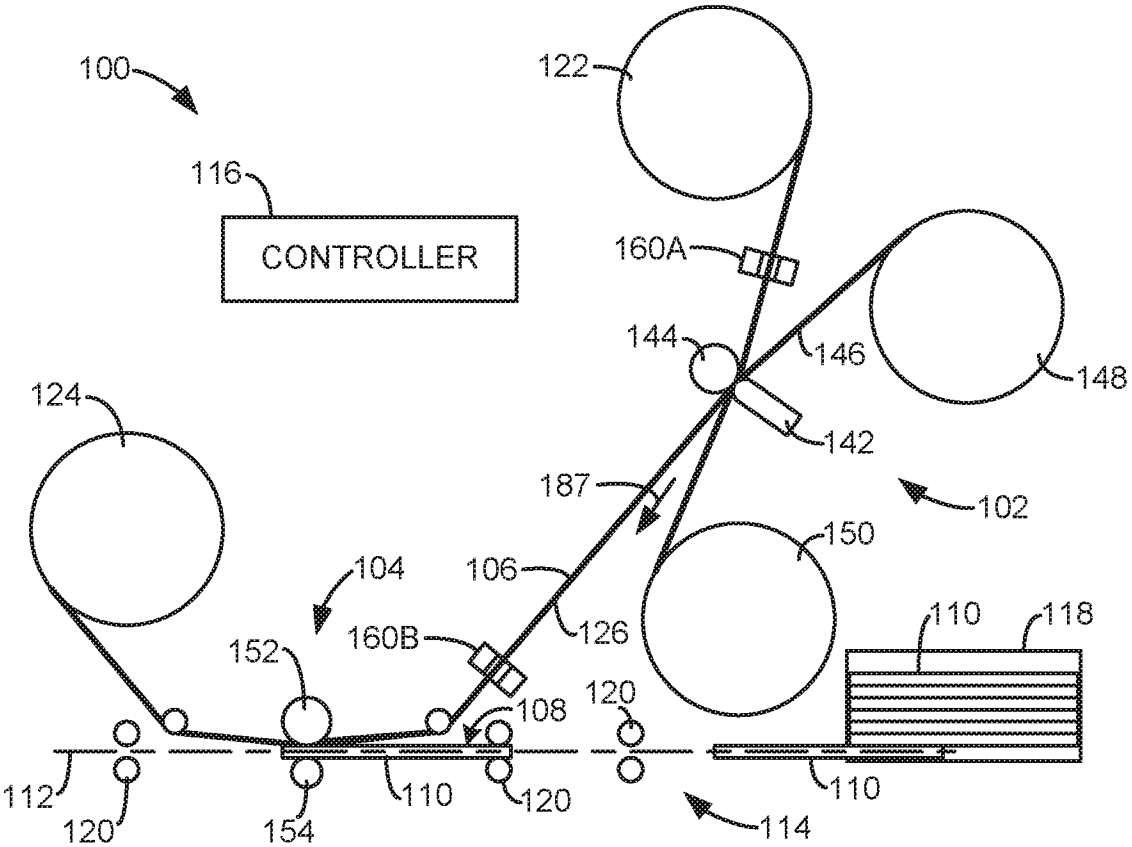
FIG. 1 is a simplified side view of an exemplary credential production device, in accordance with embodiments of the invention.

Embodiments of the invention are described more fully hereinafter with reference to the accompanying drawings. Elements that are identified using the same or similar reference characters refer to the same or similar elements. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Specific details are given in the following description to provide a thorough understanding of the embodiments. However, it is understood by those of ordinary skill in the art that the embodiments may be practiced without these specific details. For example, circuits, systems, networks, processes, frames, supports, connectors, motors, processors, and other components may not be shown, or shown in block diagram form in order to not obscure the embodiments in unnecessary detail.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will further be appreciated by one of skill in the art, the present invention may be embodied as methods, systems, devices, and/or computer program products, for example. Accordingly, the present invention may take the form of an entirely hardware embodiment, an entirely software embodiment or an embodiment combining software and hardware aspects. The computer program or software aspect of the present invention may comprise computer readable instructions or code stored in a computer readable medium or memory. Execution of the program instructions by one or more processors (e.g., central processing unit) results in the one or more processors performing one or more functions or method steps described herein. Any suitable patent subject matter eligible computer readable media or memory may be utilized including, for example, hard disks, CD-ROMs, optical storage devices, or magnetic storage devices. Such computer readable media or memory do not include transitory waves or signals.

The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present invention may also be described using flowchart illustrations and block diagrams. Although a flowchart may describe the operations as a sequential process, many of the operations can be performed in parallel or concurrently. In addition, the order of the operations may be re-arranged. A process is terminated when its operations are completed, but could have additional steps not included in a figure or described herein.

It is understood that one or more of the blocks (of the flowcharts and block diagrams) may be implemented by computer program instructions. These program instructions may be provided to a processor circuit, such as a microprocessor, microcontroller or other processor, which executes the instructions to implement the functions specified in the block or blocks through a series of operational steps to be performed by the processor(s) and corresponding hardware components.

FIG. 1 is a simplified side view of an exemplary credential production device 100 in accordance with embodiments of the invention. In some embodiments, the credential production device 100 is configured as a reverse-image printing device and includes a print unit 102, a transfer unit 104, and a transfer ribbon 106. The print unit 102 is configured to print an image to the transfer ribbon 106. The transfer unit 104 is configured to transfer the printed image from the transfer ribbon 106 to a surface 108 of a substrate 110 that is fed along a processing path 112 using a transport mechanism 114.

In some embodiments, the credential production device 100 includes a controller 116 representing one or more processors that are configured to execute program instructions stored in memory of the device, such as memory of the controller 116 or other location. The execution of the instructions by the controller 116 controls components of the credential production device 100 to perform functions and method steps described herein, such as a reverse-image printing process, for example.

The substrates 110 may take on many different forms, as understood by those skilled in the art. In some embodiments, the substrate 110 is a credential substrate. As used herein, the term "credential substrate" includes substrates used to form credentials, such as identification cards, membership cards, proximity cards, driver's licenses, passports, credit and debit cards, and other credentials or similar products. Exemplary card substrates 110 include paper substrates other than traditional paper sheets used in copiers or paper sheet printers, plastic substrates, rigid and semi-rigid card substrates, and other similar card substrates.

In some embodiments, the transport mechanism 114 is configured to feed individual substrates from a substrate supply 118 along the processing path 112, under the control of the controller 116. In some embodiments, the substrate supply 118 is in the form of a container or cartridge that is configured to contain individual substrates 110. In some embodiments, the transport mechanism 114 feeds the individual substrates 110 using one or more motorized feed rollers 120, such as the feed roller pairs shown in FIG. 1, or other suitable mechanism.

In some embodiments, the transfer ribbon 106 is supported between a supply spool 122 and a take-up spool 124 and extends along a transfer ribbon feed path 126. The transfer ribbon 106 may be fed along the transfer ribbon feed path 126 using a motorized take-up spool 124, a motorized supply spool 122, motorized feed rollers or platens, and/or other motorized ribbon feeding devices. Such motorized ribbon feeding devices may include, for example, step motors, encoders, and/or other devices that allow for controlled movement of the transfer ribbon 106 along the transfer ribbon feed path 126.

Figure 2:
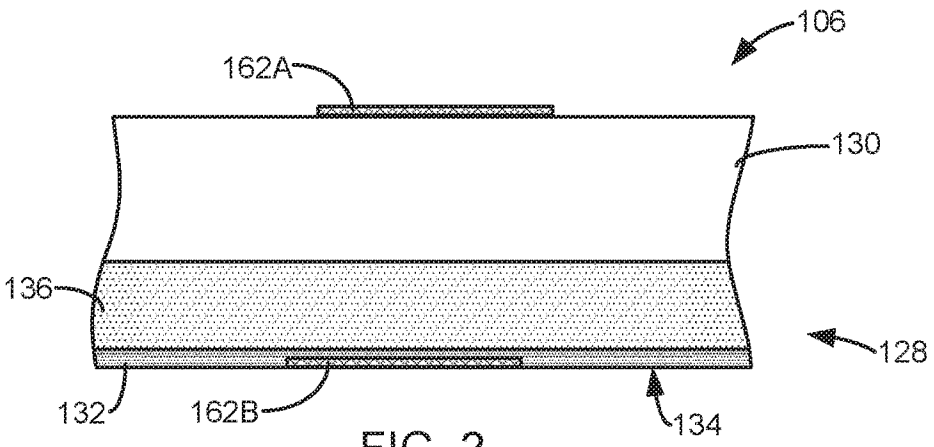
FIG. 2 is a simplified side cross-sectional view of an exemplary transfer ribbon, in accordance with embodiments of the invention.
Figure 3:
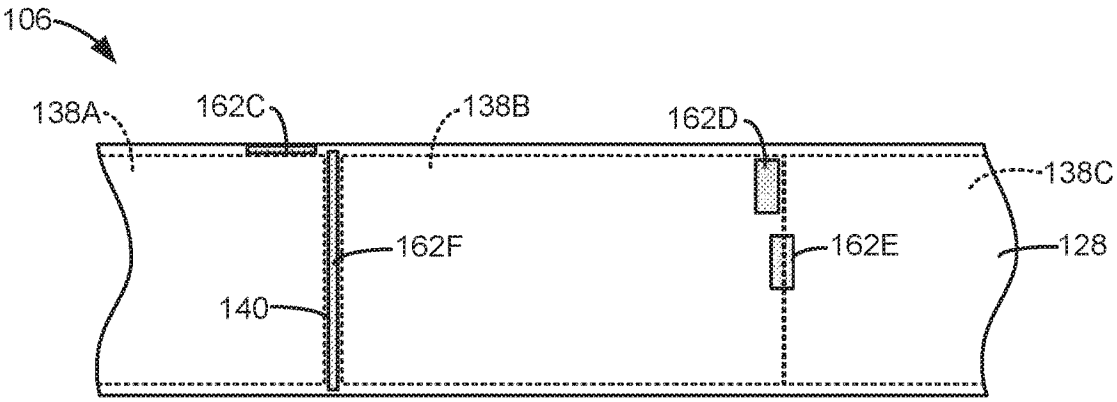
FIG. 3 is a simplified top view of the exemplary transfer ribbon of FIG. 2.

FIG. 2 is a simplified side cross-sectional view of an exemplary transfer ribbon 106 in accordance with embodiments of the invention, and FIG. 3 is a simplified top view of the exemplary transfer ribbon 106 of FIG. 2. In some embodiments, the transfer ribbon 106 includes a transfer layer 128 that is attached to a backing or carrier layer 130. The transfer layer 128 is configured to be transferred to a surface 108 of a substrate 110 through a transfer lamination process, in accordance with embodiments of the invention. In some embodiments, the transfer layer 128 is in the form of a patch laminate, or a fracturable laminate, or thin film laminate. In some embodiments, the transfer ribbon 106 comprises a series of linked patch laminates that are not carried on a carrier layer. While, embodiments of the invention are described with reference to the thin film laminate embodiment of the transfer layer ribbon 106, it is understood that embodiments of the invention also include the use of a transfer ribbon 106 comprising patch laminates.

In some embodiments, the transfer layer 128 includes an image receptive layer 132 that is configured to receive an image on or in the surface 134 printed using the print unit 102. During a reverse-image transfer operation, the imaged portion or print section of the transfer layer 128 is transferred from the carrier layer 130 to the surface 108 of the substrate 110.

In some embodiments, the transfer layer 128 includes a protective layer 136 located between the image receptive layer 132 and the carrier layer 130. Alternatively, the protective layer 136 may be combined with the image receptive layer 132. The protective layer 136 operates to provide protection to the surface 108 of a substrate 110 to which the transfer layer 128 is laminated. The protective layer 136 will also protect an image printed on or in the image receptive layer 132 when the transfer layer 128 is laminated to the surface 108 of a substrate 110.

The transfer ribbon 106 may include other conventional layers or materials that are not shown in order to simplify the illustration. These include a thermal adhesive in the image receptive layer 132, or a thermal adhesive layer on the image receptive layer 132. The thermal adhesive is activated during a conventional transfer lamination process to bond the transfer layer 128 to the surface 108 of the substrate 110.

In some embodiments, the transfer ribbon 106 includes a release layer between the transfer layer 128 and the carrier layer 130 that simplifies the release of the transfer layer 128 from the carrier layer 130 during the transfer lamination process. Other conventional materials or layers may also be included in the transfer ribbon 106.

In some embodiments, the transfer layer 128 includes transfer or print sections, which are shown in phantom lines in FIG. 3, and are generally referred to as print sections 138. The print sections 138 are portions of the transfer layer 128 that are to receive an image printed by the print unit 102, and/or are portions that are to be transferred to the surfaces 108 of substrates 110. In some embodiments, adjacent print sections 138 are separated by a gap 140, such as illustrated by exemplary print sections 138A and 138B. Thus, after the print sections 138A and 138B are transferred to a substrate 110, the transfer ribbon 106 includes a portion of the transfer layer 128 spanning the gap 140. In some embodiments, adjacent print sections 138 are not separated by a gap, such as illustrated by exemplary print sections 138B and 138C.

In some embodiments, the print unit 102 includes a print head 142. The print head 142 is configured to print an image to a print section 138 of the transfer ribbon 106, which may be supported by a print platen 144, or other suitable support. In some embodiments, the print head 142 is a conventional ink jet print head. In some embodiments, the print head 142 is a conventional thermal print head comprising a plurality of heating elements that may be individually activated to transfer print material (e.g., dye, resin, etc.) from a print ribbon 146 to the print section 138 of the transfer ribbon 106, in accordance with conventional techniques. In some embodiments, the print ribbon 146 is supported between a supply spool 148 and a take-up spool 150, one or both of which may be motorized to control the feeding of the print ribbon 146 by the controller 116.

In some embodiments, the transfer unit 104 includes a transfer device 152, such as a conventional heated transfer roller or other suitable device that is configured to transfer the imaged print section 138 of the transfer ribbon 106 to the surface 108 of the substrate 110. In some embodiments, the transfer unit 104 positions the transfer device 152 to heat and press the imaged print section 138 of the transfer layer 128 to the surface 108 while the substrate 110 is supported on a platen 154 or other support, which activates the thermal adhesive in the print section 138, and bonds the imaged print section 138 to the surface 108. The carrier layer 130 is then peeled from the bonded print section 138 to complete the reverse-image transfer printing of the printed image to the substrate 110.

Embodiments of the credential production device 100 include a configuration that does not include the print unit 102. In such a device, the transfer unit 104 operates to transfer a print or transfer section of the transfer layer 128, which may or may not include an image, to the substrate 110 to laminate the substrate 110 with the section of the transfer layer 128, for example.

During a reverse-image or transfer printing process, a print section 138 of the transfer ribbon 106 must be aligned to the print head 142 to ensure the printing of an image within the print section 138. The imaged print section 138, must then be aligned to the surface 108 of the substrate 110 during the transfer operation to ensure that the imaged print section 138 is bonded to the surface 108. The precision of these alignment operations determines the size limit of the image relative to the surface 108 that can be transferred to the surface 108 of the substrate 110. The greater the precision of the alignment operations, the larger the image that can be transferred within the borders of the surface 108.

Embodiments of the invention are directed to a print section sensor, generally designated as 160, that may be used by the controller 116 to accurately detect the location of the print sections 138 on the transfer ribbon 106, and align the print sections 138 with the print head 142 and/or transfer device 152. In some embodiments, the credential production device 100 includes a print section sensor 160A that is used by the controller 116 to detect individual print sections 138 of the transfer ribbon 106, and to control the feeding of the transfer ribbon 106 relative to the print head 142 to align the print sections 138 to the print head 142 before commencing a print operation, during which an image is printed to the print section 138 using the print head 142. In some embodiments, the credential production device 100 includes a print section sensor 160B that is used by the controller 116 to control the feeding of the transfer ribbon 106 relative to the substrate 110 to align an imaged print section 138 to the surface 108 of a substrate 110 before commencing a transfer operation, during which the imaged print section 138 is transferred to the surface 108 using the transfer device 152. In some embodiments, the credential production device 100 includes a single print section sensor 160 that may be positioned, for example, along the transfer ribbon feed path 126 between the print head 142 and the transfer device 152, and is used by the controller 116 to control the feeding of the transfer ribbon 106 relative to the print head 142 and the transfer device 152 to align individual print sections 138 to the print head 142 and the transfer device 152.

In some embodiments, each print section sensor 160 is configured to detect registration marks on the transfer ribbon 106, which are generally referred to as marks 162. Exemplary embodiments of the marks 162 are illustrated in FIGS. 2 and 3. The marks 162 each have a known position relative to one or two of adjacent print sections 138. The controller 116 uses the print section sensors 160 to detect the marks 162 and determine the location of the associated print sections 138.

The registration marks 162 may take on numerous forms. In some embodiments, the marks 162 have a form that is distinguishable from images printed to the transfer layer 128 of the transfer ribbon 106 using the print head 142. In some embodiments, the marks 162 are located on a side of the carrier layer 130 that is opposite that of the transfer layer 128, as indicated by exemplary mark 162A shown in FIG. 2. In some embodiments, the marks 162 are positioned on the same side of the carrier layer 130 as the transfer layer 128, as indicated by exemplary mark 162B shown in FIG. 2.

In some embodiments, the marks 162 include one or more marks that do not extend across a width of the transfer ribbon 106, such as illustrated by exemplary marks 162C-E shown in FIG. 3. In some embodiments, the marks 162 include one or more marks that substantially extend across a width of the transfer ribbon 106, such as illustrated by exemplary mark 162F. In some embodiments, the marks 162 include one or more marks that are entirely within a print section 138, such as illustrated by exemplary mark 162D. In some embodiments, the marks 162 include one or more marks that extend across a boundary of a print section 138, such as illustrated by mark 162E. In some embodiments, the marks 162 include one or more marks that are located adjacent an edge of the transfer ribbon 106, such as illustrated by exemplary mark 162C. The marks 162 may also take on other forms.

In some embodiments, the marks 162 are opaque (i.e., substantially non-transmissive) to wavelengths of electromagnetic energies transmitted by the print section sensor 160, such as infrared light, for example. In some embodiments, the marks 162 are reflective to wavelengths of electromagnetic energies transmitted by each of the print section sensors 160, such as infrared light, for example. It is understood that the marks and the corresponding electromagnetic energy transmitted by the print section sensors 160 can take on other forms.

Figure 4:
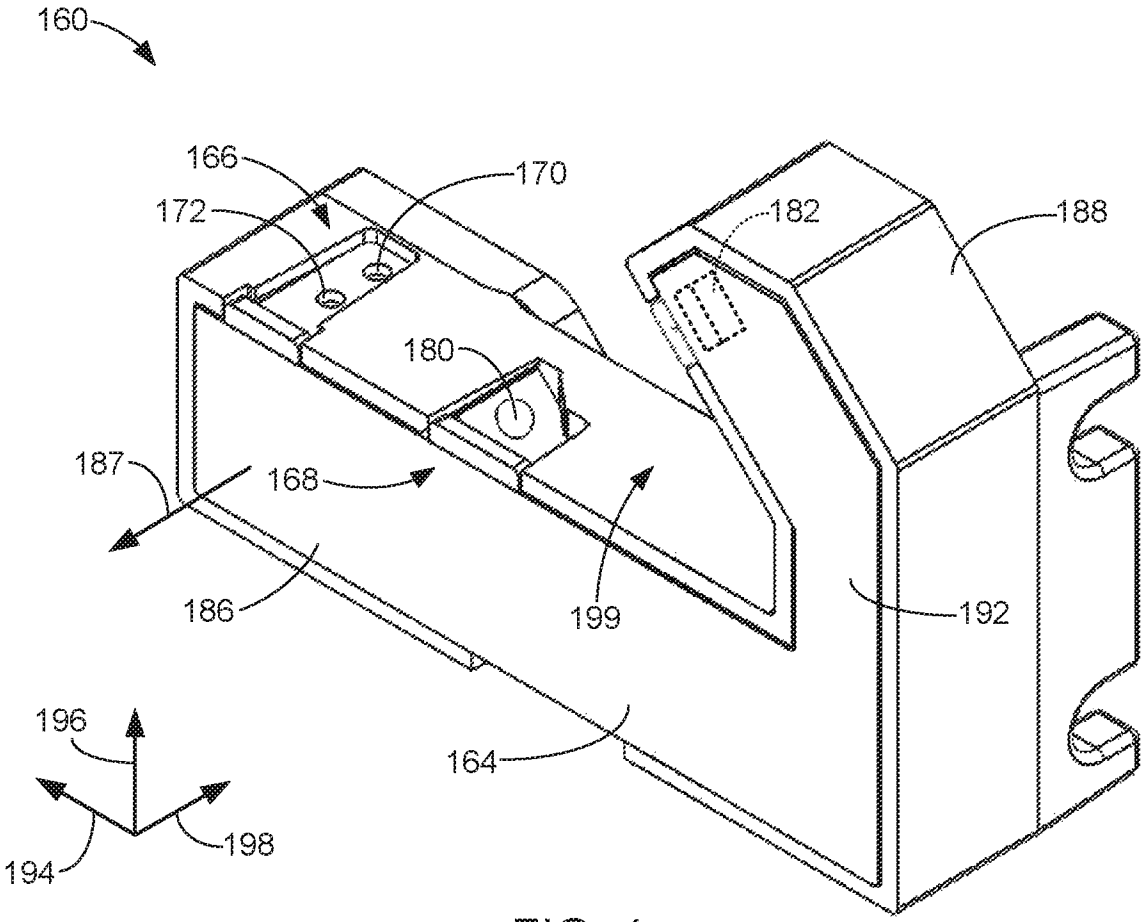
FIG. 4 is an isometric view of an exemplary print section sensor, in accordance with embodiments of the invention.
Figure 5:
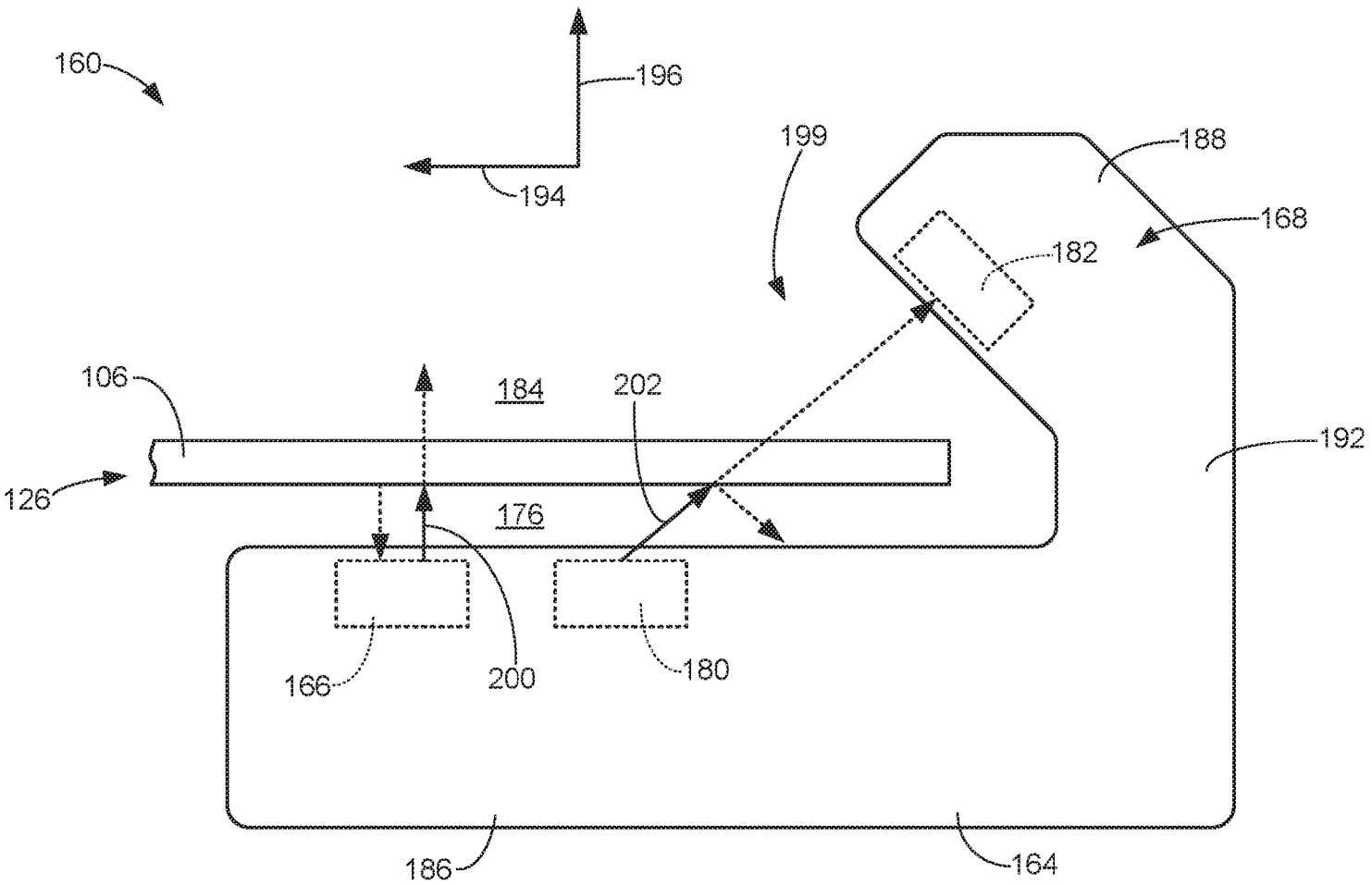
FIG. 5 is a simplified front view of the exemplary print section sensor of FIG. 4 supported adjacent a transfer ribbon, in accordance with embodiments of the invention.
Figure 6:
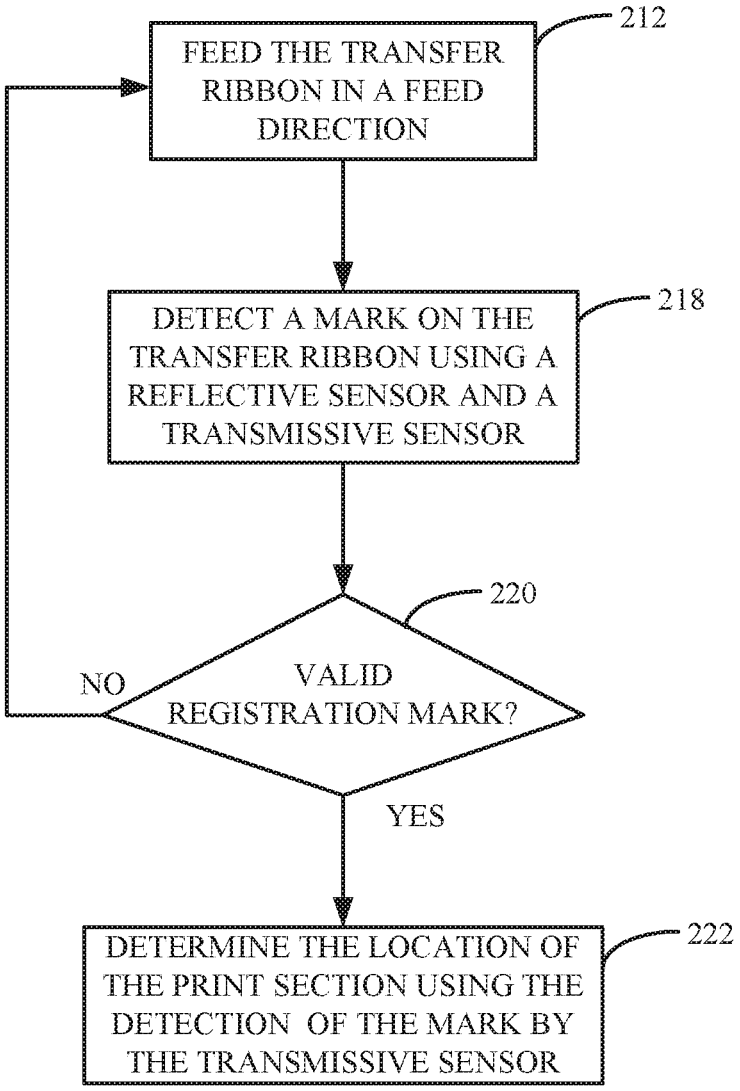
FIG. 6 is a flowchart illustrating an exemplary method of detecting a print section of a transfer ribbon, in accordance with exemplary embodiments of the invention.

Embodiments of the print section sensor 160 will be described with reference to FIGS. 4-10. FIG. 4 is an isometric view of an exemplary print section sensor 160, in accordance with embodiments of the invention. FIG. 5 is a simplified front view of the exemplary print section sensor 160 of FIG. 4 supported adjacent a transfer ribbon 106, in accordance with embodiments of the invention. FIG. 6 is a flowchart illustrating a method of detecting a print section 138 of a transfer ribbon 106, in accordance with exemplary embodiments of the invention. FIGS. 7-10 are simplified side views of an exemplary sensor 160 supported adjacent a transfer ribbon 106 illustrating steps of an exemplary method of detecting a print section 138 of the transfer ribbon 106, in accordance with embodiments of the invention.

In some embodiments, the sensor 160 includes a housing 164, a reflective sensor 166, and a transmissive sensor 168, as shown in FIGS. 4 and 5. The housing 164 is configured to be positioned adjacent to a transfer ribbon feed path 126, in which a transfer ribbon 106 is supported, as shown in FIGS. 1 and 5. In some embodiments, the reflective sensor 166 is supported by the housing 164, and is configured to detect registration marks 162 on the transfer ribbon 106. In some embodiments, the transmissive sensor 168 is supported by the housing 164, and is configured to detect the registration marks 162 on the transfer ribbon 106.

Figure 7:
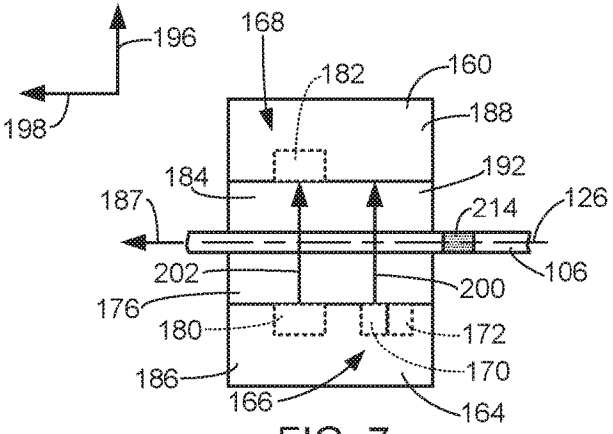
FIGS. 7-10 are simplified side views of an exemplary sensor supported adjacent a transfer ribbon illustrating steps of the method of detecting a print section of a transfer ribbon, in accordance with embodiments of the invention.

In some embodiments, the reflective sensor 166 includes an emitter 170 and a receiver 172 that are supported by the housing 164 on a side 176 of the transfer ribbon 106, as shown in FIGS. 5 and 7. In some embodiments, the transmissive sensor 168 includes an emitter 180 and a receiver 182, as shown in FIGS. 4 and 5. In some embodiments, the emitter 180 and the receiver 182 are positioned on opposing sides of the transfer ribbon feed path 126 and the supported ribbon 106, as shown in FIG. 5. In some embodiments, the emitter 180 is located on the side 176 of the transfer ribbon 106 or transfer ribbon feed path 126, while the receiver 182 is located on a side 184 of the transfer ribbon 106 or the transfer ribbon feed path 126, as shown in FIG. 5. Alternatively, these positions of the emitter 180 and the receiver 182 of the transmissive sensor 168 may be reversed.

In some embodiments, the emitter 170 and the receiver 172 of the reflective sensor 166 are supported by a first section 186 of the housing 164, as shown in FIGS. 4 and 5. In some embodiments, the emitter 170 is located downstream from the receiver 172 relative to a feed direction 187, in which the transfer ribbon 106 is fed along the transfer ribbon feed path 126, as shown in FIGS. 4 and 7. In some embodiments, the positions of the emitter 170 and the receiver 172 relative to the feed direction 187 is reversed such that the emitter 170 is located upstream from the receiver 172 relative to a feed direction 187.

In some embodiments, the emitter 180 of the transmissive sensor 168 is supported by the first section 186 of the housing 164, while the receiver 182 is supported by a second section 188 of the housing 164, as shown in FIGS. 4 and 5. Alternatively, the receiver 182 of the transmissive sensor 168 may be supported by the first section 186 of the housing 164, while the emitter 180 is supported by the second section 188 of the housing 164.

In some embodiments, the housing 164 includes a third section 192 that connects the first section 186 to the second section 188, as shown in FIGS. 4 and 5. In some embodiments, the housing 164 is U-shaped or J-shaped, as shown in FIGS. 4 and 5.

In some embodiments, the first section 186 and the second section 188 of the housing 164 extend along a first axis 194 that is transverse to the feed direction 187 of the transfer ribbon 106, and the third section 192 extends along the second axis 196 that is perpendicular to the first axis 194, and is transverse to the feed direction 187, as shown in FIGS. 4 and 5. In some embodiments, the receiver 182 of the transmissive sensor 168 is displaced from the emitter 170 and the receiver 172 of the reflective sensor 168 along a third axis 198 that is perpendicular to the axes 194 and 196, and parallel to the feed direction 187 of the transfer ribbon 106, as shown in FIG. 7. In some embodiments, the emitter 180 of the transmissive sensor 168 is displaced from the emitter 170 and/or the receiver 172 of the reflective sensor 166 along the axis 194 toward the second section 188 and the third section 192, as shown in FIG. 5.

In some embodiments, the emitter 180 and the receiver 182 of the transmissive sensor 168 are separated by a gap 199, through which the transfer ribbon feed path 126 or the transfer ribbon 106 extends, as shown in FIG. 5. In some embodiments, the gap 199 extends partially along the axis 196 between the first section 186 and the second section 188 of the housing 164.

The emitter 170 of the reflective sensor 166 is configured to transmit electromagnetic energy 200 along the axis 196 toward the transfer ribbon 106 or the transfer ribbon feed path 126, and the receiver 172 is configured to detect the electromagnetic energy 200 that is reflected from the transfer ribbon 106, as illustrated in FIG. 5. The emitter 180 of the transmissive sensor is configured to emit electromagnetic energy 202 toward the transfer ribbon 106 or the transfer ribbon feed path 126 in the direction of the receiver 182, and the receiver 182 is configured to detect the electromagnetic energy 202 that passes through the transfer ribbon 106, as illustrated in FIG. 5. In some embodiments, the emitters 170 and 180 may be recessed within the housing 164 to limit the projection of the electromagnetic energy 200 and 202. In some embodiments, the receivers 172 and 182 may be recessed within the housing 164, or have a suitable aperture to ensure proper operation of the sensors 166 and 168.

The wavelength and intensity of the electromagnetic energies 200 and 202 may be selected as desired. In some embodiments, at least one of the electromagnetic energies 200 and 202 comprises infrared light, and the registration marks 162 are configured to reflect the wavelengths of the infrared light. In some embodiments, the registration marks 162 are white and therefore will reflect much of the intensity of the upcoming light at any wavelength. Other wavelengths for the electromagnetic energies 200 and 202 may also be used. In some embodiments, the magnitude, and/or wavelength or wavelength range of the electromagnetic energy 202 discharged by the emitter 180 of the transmissive sensor 168 is different than the electromagnetic energy 200 discharged from the emitter 170 of the reflective sensor 166.

The magnitude of the electromagnetic energy 200 discharged from the emitter 170 that is reflected from a portion of the transfer ribbon 106 that does not include a registration mark 162 is different from the magnitude of the electromagnetic energy 200 that is reflected from a registration mark 162 of the transfer ribbon 106. This difference in the magnitude of the reflected electromagnetic energy 200 that is detected by the receiver 172 is used by the controller 116 to determine whether the electromagnetic energy 200 has reflected off a registration mark 162 on the transfer ribbon 106, or a portion of the transfer ribbon 106 that lacks a registration mark 162.

Figure 8:
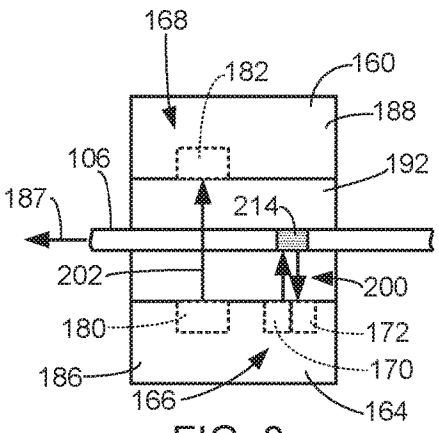

In some embodiments, the electromagnetic energy 200 transmitted by the emitter 170 of the reflective sensor 166 is selected to be more transmissive through portions of the transfer ribbon 106 where a registration mark 162 is not present, resulting in a significant transmission of the electromagnetic energy 200 through the transfer ribbon 106, as indicated in FIG. 7. In some embodiments, the registration marks 162 of the transfer ribbon 106 have a greater reflectivity or reduced transmissivity of the electromagnetic energy 200. Thus, when a registration mark 162 is positioned to receive the electromagnetic energy 200 discharged from the emitter 170, a greater portion of the electromagnetic energy 200 is reflected toward the receiver 172, as shown in FIG. 8. As a result, the receiver 172 of the reflective sensor 166 detects a higher magnitude of the electromagnetic energy 200 when the electromagnetic energy 200 encounters a registration mark 162 (FIG. 8) than when the electromagnetic energy 200 does not encounter a registration mark 162 (FIG. 7).

It is understood that, in alternative embodiments, the transmissivity or reflectivity of the registration marks 162 to the electromagnetic energy 200 relative to other portions of the transfer ribbon 106 that do not include a registration mark 162, could be reversed. That is, the electromagnetic energy 200 has greater transmissivity through the registration marks 162 than through the portions of the transfer ribbon 106 that do not include a registration mark 162.

In some embodiments, the reflective sensor 166 generates an output signal that indicates a magnitude of the electromagnetic energy 200 that is detected by the receiver 172. The output signal may be an analog signal or a digital signal. The controller 116 uses the output signal from the receiver 172 to determine whether a registration mark 162 is positioned at a predefined location relative to the reflective sensor 166. For example, the controller 116 may determine that a registration mark 162 is in the predefined location relative to the reflective sensor 166 when the output signal from the receiver 172 indicates the detection of at least a threshold magnitude of the electromagnetic energy 200.

The registration mark 162 diffuses the electromagnetic energy 200 discharged from the emitter. When a leading edge of the mark 162 gets close to the receiver 172, light from the emitter 170 will hit the mark 162 and scatter the electromagnetic energy 200 in different directions. As the mark 162 gets closer to the receiver 172, the magnitude of the reflected electromagnetic energy 200 entering the receiver will increase. Due to the electromagnetic energy 200 being diffused after hitting the mark 162, the reflective sensor 166 will not be highly accurate in locating the edge of the mark 162. The reflective sensor 166 will identify that a registration mark 162 is close, but it will not accurately identify the position of the mark 162. The reflective sensor can also determine if the leading or trailing edge of the registration mark 162 is passing the sensor 166 based on the magnitude of the reflected electromagnetic energy 200 over a period of time.

The emitter 180 of the transmissive sensor 168 is configured to discharge electromagnetic energy 202 toward the receiver 182, as indicated in FIG. 5. The receiver 182 generates an output signal that is indicative of a magnitude of the electromagnetic energy 202 that is received by the receiver 182. This output signal is used by the controller 116 to determine whether a registration mark 162 or a portion of a printed image is positioned in a predetermined location on the transfer ribbon 106 relative to the transmissive sensor 168.

In some embodiments, the electromagnetic energy 202 has a greater transmissivity through portions of the transfer ribbon 106 that do not include a registration mark 162 or a printed image. When a printed image or a registration mark 162 is not positioned between the emitter 180 and the receiver 182 of the transmissive sensor 168 (FIG. 7), a high magnitude of the electromagnetic energy 202 is detected by the receiver 182. When a registration mark 162 or a printed image is positioned between the emitter 180 and the receiver 182 (FIG. 10), at least a portion of electromagnetic energy 202 is blocked from reaching the receiver 182, resulting in a reduction in the magnitude of the electromagnetic energy 202 that is detected by the receiver 182. Thus, the electromagnetic energy 202 discharged from the emitter 180 will initially be substantially received by the receiver 182 when the mark 162 is displaced from the sensor 168, and will be blocked or substantially blocked from entering the receiver 182 when the leading edge of the registration mark 162 passes between the emitter 180 and the receiver 182 of the sensor 168. The electromagnetic energy 202 will again begin entering the receiver 182 when the trailing edge of the registration mark 162 passes the sensor 168. Thus, the leading and trailing edges of the mark 162 can be determined by the controller 116 by the change in the magnitude of the electromagnetic energy 200 received by the receiver 182 over a period of time.

Some embodiments of the invention are directed to a method of detecting the print section 138 or a location of a print section 138 through the detection of a registration mark 162 using the sensor 160. In some embodiments of the method, the output signals from the reflective sensor 166 and the transmissive sensor 168 of the sensor 160 are used by the controller 116 to distinguish registration marks 160 from other marks on the transfer ribbon 106, such as marks printed using the print head 142, pre-printed marks on the transfer ribbon 106, or other marks on the transfer ribbon 106. This increases the likelihood of accurately identifying print sections 138 of the transfer ribbon 106.

Referring now to the flowchart of FIG. 6 and FIGS. 7-10, embodiments of an exemplary method of detecting a print section 138 of a transfer ribbon 106 using the sensor 160 will be described. Initially, a print section sensor 160 having a reflective sensor 166 and a transmissive sensor 168 is supported adjacent a transfer ribbon 106, as shown in FIG. 7. The sensor 160 may be supported adjacent the transfer ribbon 160 by attaching the sensor 160 to a frame (not shown) of the device 100, for example.

At 212, the transfer ribbon 106 is fed in a feed direction 187 relative to the sensor 160 under the control of the controller 116 using a suitable ribbon feeding device. During some periods of step 212, neither the reflective sensor 166, nor the transmissive sensor 168 detects a mark 214 on the transfer ribbon 106, because the mark 214 is displaced from the sensors 166 and 168, as shown in FIG. 7. In particular, the magnitude of the electromagnetic energy 200 reflected from the transfer ribbon 106 and received by the receiver 172 is too low relative to a predefined first threshold value to indicate the presence of a mark in the predefined location relative to the sensor 166 that could be a candidate for a registration mark 162. Similarly, the magnitude of the electromagnetic energy 202 detected by the receiver 182 of the transmissive sensor 168 is too high relative to a predefined second threshold value to indicate the presence of a mark in the predefined location relative to the sensor 168 that could be a candidate for a registration mark 162.

Figure 9:
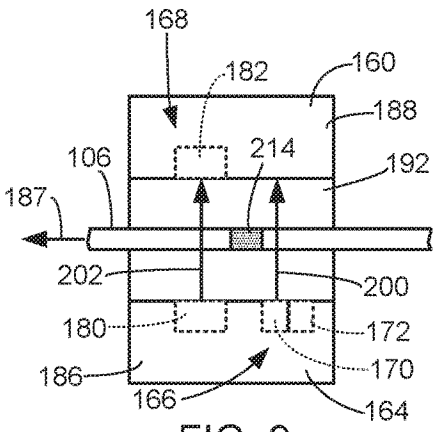
Figure 10:
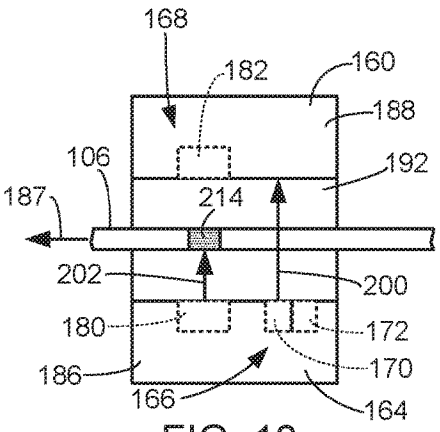

During the period of step 212, a candidate mark 214 (or portion thereof) on the transfer ribbon 106 is detected using the reflective sensor 166 and the transmissive sensor 168, as indicated at step 218 of the method. In some embodiments, the detection of the candidate mark 214 using the reflective sensor 166 is either before or after the detection of the candidate mark 214 using the transmissive sensor 168. For example, when the reflective sensor 166 is located upstream from the transmissive sensor 168 relative to the feed direction 187 of the transfer ribbon, as shown in FIGS. 7-10, the candidate mark 214 of the transfer ribbon 106 initially moves into the predetermined location relative to the reflective sensor 166, while the predetermined location relative to the sensor 168 remains free of the mark 214, as shown in FIG. 8. Subsequently, the candidate mark 214, such as a leading or trailing edge of the candidate mark 214, is detected using the transmissive sensor 168, as indicated in FIG. 10.

Alternatively, the feed direction 187 may be reversed, such that the candidate mark 214 initially enters the predetermined location relative to the transmissive sensor 168 (FIG. 10), then the mark 214 enters the predetermined location relative to the reflective sensor (FIG. 8), during the feeding step 212. In accordance with this embodiment, it may be necessary to ensure that the registration marks 162 extend sufficiently along the length of the transfer ribbon 106, such that it can extend simultaneously through the predetermined locations relative to the transmissive sensor 168 and the reflective sensor 166. This would allow the transmissive sensor 168 to detect the trailing edge of the registration mark 162 after the detection of the registration mark 162 using the reflective sensor 166.

During the detection of the candidate mark 214 using the reflective sensor 168 in step 218, a portion of the electromagnetic energy 200 is reflected off the mark 214 and is detected by the receiver 172. At 220, the controller 116 determines whether the mark 214 qualifies as a valid or actual registration mark 162, or whether the mark 214 is a non-registration mark on the transfer ribbon 106, such as a printed mark or other mark on the transfer ribbon 106. In some embodiments of step 220, the controller 116 analyzes the output signal from the receiver 172, which indicates the magnitude of the detected electromagnetic energy 200 reflected from the mark 214. In some embodiments, the controller 116 compares this detected magnitude to a threshold value. If the detected magnitude does not meet a predetermined relationship to the threshold value, the controller 116 determines that the candidate mark 214 is not an actual registration mark 162. In some embodiments, the controller 116 determines that the mark 214 is a valid registration mark 162 when the detected magnitude exceeds the threshold value, such as when the registration mark 162 is a white or highly reflective mark relative to other non-registration mark portions of the transfer ribbon 106.

In some embodiments, this will end the method with regard to the candidate mark 214, and it becomes unnecessary to detect the mark 214 using the transmissive sensor 168 (step 218), such as when the transmissive sensor 168 is downstream from the reflective sensor 166, or to proceed with the determination of the location of a print section based on the detection of the mark 214 by the transmissive sensor 168. Accordingly, in some embodiments, the method returns to step 212, as indicated in FIG. 6 when it is determined that the mark 214 is not a valid registration mark. In some other embodiments, which may depend on the nature of the registration mark, the analysis of the output signal from the receiver 172 by the controller 116 could be much more complicated. For example, in high security devices (e.g., high security printers), the registration marks 162 could be configured to produce a very specific spectral response to the electromagnetic energy 200 discharged from the emitter 170, such as, for example, fluorescent marks. For instance, in some embodiments, the controller 116 is configured to perform a full or partial spectral analysis of the output signal from the receiver 172 to determine whether the output signal a matches the expected output signal produced by the receiver 172 in response to the detection of an actual registration mark.

In some embodiments, during the detecting step 218, an output signal from the receiver 182 of the transmissive sensor 168 is analyzed by the controller 116 to determine if the registration mark 214 is in the predefined location relative to the transmissive sensor 168 (FIG. 10). In some embodiments, the controller 116 analyzes the output signal from the receiver 182, which indicates the magnitude of the detected electromagnetic energy 202 transmitted through the transfer ribbon 106. In some embodiments, the controller 116 compares this detected magnitude to a threshold value, which may include analyzing the detected magnitude over time, to detect when the leading or trailing edge of the mark 214 is in the predefined location, as discussed above. If the detected magnitude does not meet a predetermined relationship to the threshold value, the controller 116 determines that the candidate registration mark 214 is not in the predetermined location relative to the transmissive sensor 168, and the transfer ribbon 106 continues to be fed in the feed direction 187 (step 212), as shown in FIG. 9, for example. If the detected magnitude reaches the predetermined relationship to the threshold value, the controller 116 determines that the candidate registration mark 214, such as a leading or trailing edge of the mark 214 is in the predetermined location relative to the transmissive sensor 168 (FIG. 10).

In some embodiments, after the initial detection of the mark 214 by the reflective sensor 166 or the transmissive sensor 168 in step 218, the controller 116 feeds the transfer ribbon a predetermined distance to initially position the mark 214 proximate to the predetermined location relative to the sensor 166 or 168 using the ribbon feeding devices of the device 100, based on a known fixed distance between the predefined location relative to the sensor 166 to the predefined location relative to the sensor 168. This feeding step can be accomplished with high precision due to the reflective sensor 166 and the transmissive sensor 168 being supported in a single housing 164, in accordance with some embodiments. The transfer ribbon 106 is then fed further in the feed direction 187 to ensure that the registration mark 214 reaches the predetermined location relative to the reflective sensor 166 or the transmissive sensor 168. This may be particularly beneficial when the mark 214 has been validated in step 220, but not yet detected by the transmissive sensor 168.

If the mark 214 has been validated in step 220 as an actual registration mark (i.e., a mark 162), the detection of the mark 214 using the transmissive sensor in step 218, such as the detection of the leading or trailing edge of the mark 214, is used by the controller 116 to determine the location of the corresponding print section 138, as indicated at step 222. The controller 116 can then control the feeding of the transfer ribbon 106 to perform a process on the print section 138.

One advantage to some embodiments of the method and the print section sensor 160, is the reduction of data processing that must be performed by the controller 116. For instance, the controller 116 may avoid processing the output signals from the receiver 182 of the transmissive sensor 168 until an actual registration mark 162 is detected in step 220 and the detected registration mark 162 is moved proximate to the predetermined location relative to the transmissive sensor 168. Another advantage to some embodiments of the method and the print section sensor 160 is achieved by the separation of the validating and locating tasks respectively between the reflective sensor 166 and the transmissive sensor 168. This allows for more accurate identification of the registration marks (i.e., less misidentification of non-registration marks as registration marks), and greater precision in determining the location of the registration marks and their associated print sections 138 than would be possible using only a single sensor, for example.

After the location of the print section 138 is determined in step 222, the controller 116 moves the print section 138 to a predefined position to perform a process on the print section 138. In some embodiments, the predefined position is a position that is aligned with the print head 142, the transfer device 152, a substrate 110 in the processing path 134, and/or other position along the transfer ribbon feed path 126. As mentioned above, this movement of the transfer ribbon 106 may be driven by a motorized take-up spool 124, a motorized supply spool 122, motorized feed rollers, such as a motorized platen roller 144 or 154, and/or other motorized ribbon feeding devices. Also, such motorized ribbon feeding devices may include, for example, step motors, encoders, and/or other devices that allow for controlled movement of the detected print section 138 to the desired predefined location.

In some embodiments, the sensor 160, corresponds to the sensor 160A (FIG. 1) that is used by the controller 116 to control the feeding of the print sections 138 of the transfer ribbon 106 relative to the print head 142. In accordance with this embodiment, the controller 116 uses the determination of the location of the print section 138 in step 222 to position the detected print section 138 in alignment with the print head 142, and perform a print operation on the detected print section 138. In some embodiments, the alignment of the detected print section 138 with the print head 142 involves aligning a leading edge of the print section 138 with the print head 142, for example. In some embodiments of the method, an image is printed to the surface 134 of the print section 138 using the print head 142, as the transfer ribbon 106 and the detected print section 138 is fed along the transfer ribbon feed path 126.

When the sensor 160 corresponds to the sensor 160B (FIG. 1), the controller 116 uses the determination of the location of the print section 138 in step 222 of the method to perform a transfer operation using the detected print section 138. In some embodiments, the controller 116 controls the feeding of the transfer ribbon 106 to align the detected print section 138 to the transfer device 152 and/or the substrate 110, such as by aligning a leading edge of the detected print section 138 to a leading edge of the substrate 110. As discussed above, in some embodiments, the transfer device 152 heats and presses the detected print section 138 against the surface 108 of the substrate 110, as the substrate 110 and the print section 138 are fed along the processing path 112, as shown in FIG. 1. The carrier layer 130 is then removed from the print section 138 that has bonded to the surface 108 to complete the transfer operation.

In some embodiments, the detected print section 138 that is transferred to the substrate 110 using the transfer device 152 includes an image that was printed during the print operation described above. Thus, in some embodiments, the transfer operation results in the transfer of the printed image to the substrate 110.

Although the present invention has been described with reference to preferred embodiments, workers skilled in the art will recognize that changes may be made in form and detail without departing from the spirit and scope of the invention.

COPYRIGHT AND LEGAL NOTICES

A portion of the disclosure of this patent document contains material which is subject to copyright protection in the United States. The copyright owner has no objection to the facsimile reproduction by anyone of the patent document or the patent disclosure, as it appears in the Patent and Trademark Office patent files or records, but otherwise reserves all copyrights whatsoever. Copyright Assa Abloy AB, Stockholm, Sweden

What is claimed is:

1. A method of determining a location of a print section of a transfer ribbon comprising:

detecting a mark on the transfer ribbon using a reflective sensor and a transmissive sensor;

validating that the mark is a registration mark using the reflective sensor, wherein the registration mark indicates the location of the print section on the transfer ribbon; and determining the location of the print section based on detecting the registration mark using the transmissive sensor.

2. The method according to claim 1, further comprising ignoring marks on the transfer ribbon that are detected using the transmissive sensor that have not been validated using the reflective sensor.

3. The method according to claim 1, further comprising:

aligning the print section of the transfer ribbon to a printing device based on determining the location of the print section; and printing an image to the print section of the transfer ribbon using the printing device.

4. The method according to claim 3, wherein:

the printing device comprises a print head and a print ribbon; and printing an image to the print section comprises printing an image to the print section of the transfer ribbon using the print head and the print ribbon.

5. The method according to claim 3, further comprising:

aligning the print section of the transfer ribbon having the image to a transfer device based on determining the location of the print section; and transferring the print section to a surface of a substrate using the transfer device.

6. The method according to claim 1, further comprising:

aligning the print section of the transfer ribbon to a transfer device based on determining the location of the print section; and transferring the print section to a surface of a substrate using the transfer device.

7. The method according to claim 1, wherein detecting a registration mark using the reflective sensor comprises:

emitting first electromagnetic energy from a first emitter; and detecting the first electromagnetic energy reflected from the registration mark using a first receiver.

8. The method according to claim 7, wherein detecting the registration mark using the transmissive sensor comprises:

emitting second electromagnetic energy from a second emitter; and detecting an attenuation of the second electromagnetic energy transmitted through the transfer ribbon using a second receiver.

9. A print section sensor for detecting print sections of a transfer ribbon having registration marks that indicate the location of the print sections on the transfer ribbon according to the method of claim 1, the print section sensor comprising:

a housing configured to be positioned adjacent to the transfer ribbon;

a reflective sensor supported by the housing and configured to authenticate the registration marks; and a transmissive sensor supported by the housing and configured to detect the position of the registration marks.

10. The print section sensor according to claim 9, wherein:

the reflective sensor comprises a first emitter and a first receiver supported by the housing on a first side of the transfer ribbon; and the transmissive sensor comprises a second emitter and a second receiver that are supported by the housing on opposing sides of the transfer ribbon.

11. The method according to claim 10, wherein the registration mark is located on the first side of the ribbon.

12. The method according to claim 10, wherein the reflective sensor is located upstream of the transmissive sensor relative to a feed direction of the transfer ribbon.

13. The method according to claim 1, further comprising supporting the reflective sensor and the transmissive sensor by a housing positioned adjacent to the transfer ribbon.

14. The method according to claim 13, wherein supporting the reflective sensor and the transmissive sensor by a housing comprises:

supporting a first emitter and a first receiver of the reflective sensor on a first side of the transfer ribbon using the housing; and supporting a second emitter and a second receiver on opposing sides of the transfer ribbon using the housing.

15. The method according to claim 14, wherein the registration mark is located on the first side of the ribbon.

16. The method according to claim 14, further comprising feeding the transfer ribbon in a feed direction, wherein the reflective sensor is located upstream of the transmissive sensor relative to the feed direction.

* * * * *